United States Patent [19]

Sada et al.

[11] 4,202,427

[45] May 13, 1980

[54] DERRICK ESCAPE SYSTEM

[75] Inventors: Charles A. Sada, Garden Grove, Calif.; William F. McKamie, Missouri City, Tex.

[73] Assignee: Santa Fe International Corporation, Orange, Calif.

[21] Appl. No.: 908,547

[22] Filed: May 22, 1978

[51] Int. Cl.[2] ..... A62B 1/02

[52] U.S. Cl. ..... 182/2; 182/48; 182/82; 182/142

[58] Field of Search ..... 182/2, 82, 141, 142, 182/143, 144, 191, 190, 10, 48; 187/6, 7, 8

[56] References Cited

U.S. PATENT DOCUMENTS

| | | | |
|---|---|---|---|
| 3,262,518 | 7/1966 | Webb | 182/48 |
| 3,796,281 | 3/1974 | Dowling | 182/48 |
| 3,826,335 | 7/1974 | Allen | 182/10 |
| 3,880,254 | 4/1975 | Fitzgerald | 182/2 |
| 4,098,371 | 7/1978 | Cox | 182/2 |

*Primary Examiner*—Reinaldo P. Machado
*Attorney, Agent, or Firm*—LeBlanc, Nolan, Shur & Nies

[57] ABSTRACT

An escape system for delivering personnel on a drilling rig to a safe location in the event of a blow out or other dangerous situation. More specifically, a personnel capsule is releasably maintained in an unbalanced disposition by an A-frame structure adjacent the racking board level of the derrick of an oil drilling rig. In the event of a blow out the personnel can enter the capsule and activate the release mechanism which will allow the A-frame to pivot outwardly away from the derrick. A control system is integrated with the A-frame and capsule to control their movement and to lower the capsule to a predetermined safe location.

101 Claims, 22 Drawing Figures

708
702
702
784

4
780
780
206
710
218
2
712
306
764
300
758
306

FIG 14
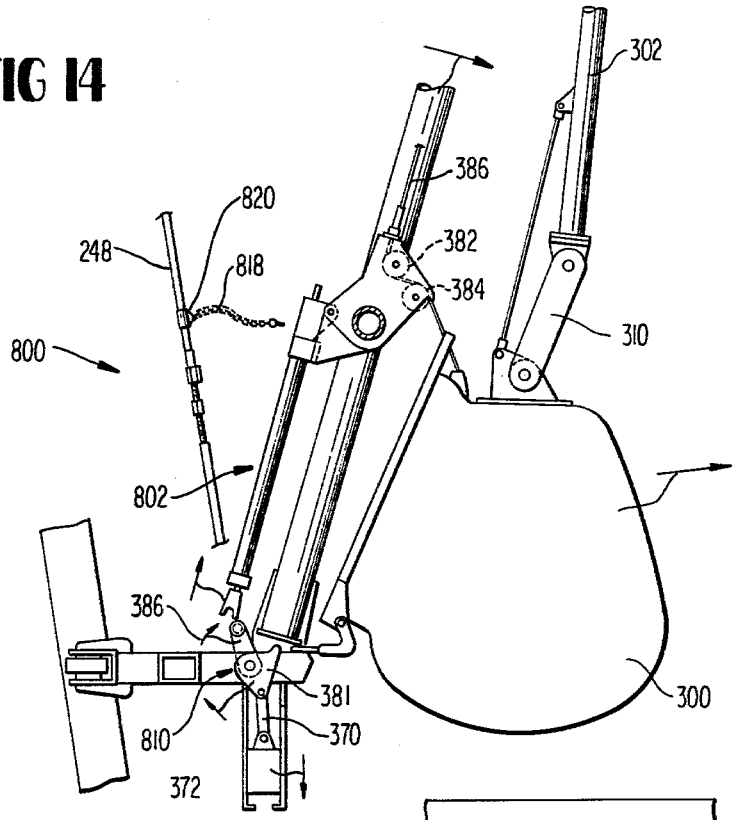
FIG 14a
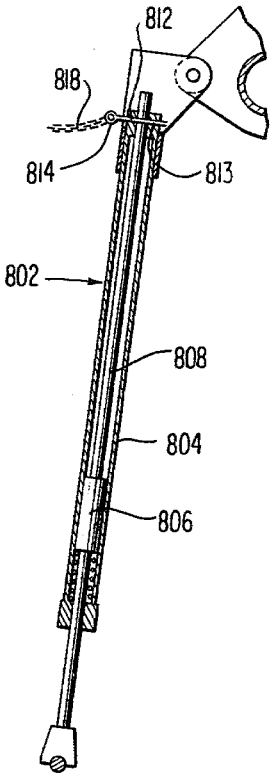
FIG 15
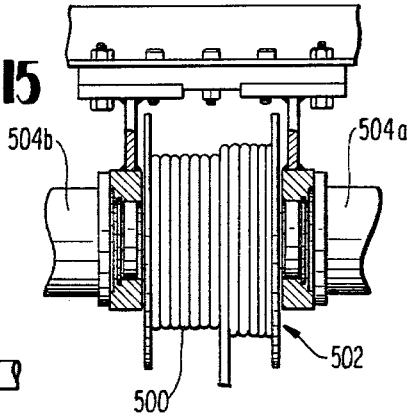
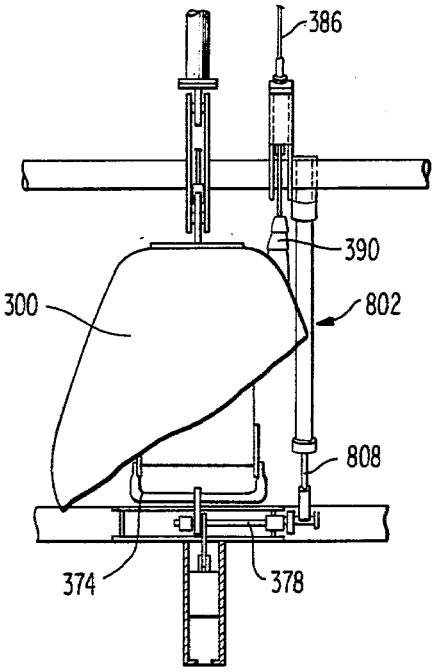
FIG 14b
FIG 14c
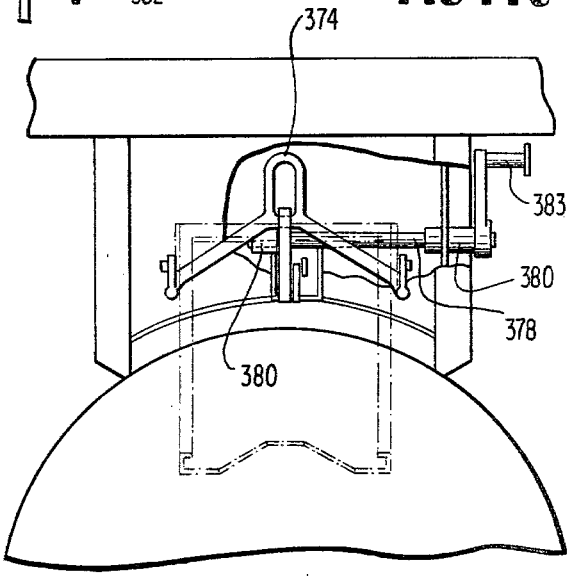

DERRICK ESCAPE SYSTEM

BACKGROUND OF THE INVENTION

This invention relates generally to safety systems; more particularly, this invention is concerned with an escape system for safely and rapidly lowering personnel to a safe level (e.g., the ground) from a relatively high point. Still more particularly, this invention is directed to an escape system for lowering personnel to the ground or deck level from an elevated location such as the racking board level, of a drilling rig, or similar tower-like structure.

In oil drilling rigs and in particular, offshore drilling rigs, situations arise where the personnel on the rig must be removed from the derrick immediately to avoid injury due to blowout or other imminent danger. For example, where a man is working on the racking level, putting the drilling pipe in order, there presently exists no quick and efficient way for him to be removed from that level should a blowout occur.

Methods have been developed for transporting personnel off of drilling platforms where fire or other hazards exist. However, these have typically been mechanisms which do not operate with the urgency required for immediate displacement from a danger zone. An example of this is U.S. Pat. No. 3,880,254, where there is shown a boom which is maintained in a biased position to take advantage of gravity or bouyancy to pivot the boom from the rig. But, when released, the boom rotates into the water adjacent an offshore drilling platform. A lifeline connected to the boom head allows personnel desiring to escape from the platform to simply slide down the lifeline to the head at the end of the boom. This type of mechanism does not actually move personnel away from a danger zone but simply provides a path and a platform at the end of the path to which personnel may eventually escape. Furthermore, it does not provide an effective means for removing personnel from the racking board level, where often the danger is most imminent, in a quick and efficient manner.

In a blow-out situation there is usually the danger of fire. In addition to the danger from flying objects, such as rocks, pipe lengths, etc., and high pressure fluid streams erupting from the hole, all of which can cause bodily injury to personnel, there is the real danger of a spark igniting the oil or gas spewing out to heights which may be greater than the total height of the rig itself. It is, therefore, imperative, not only to provide a means for permitting rapid escape from, say, the racking level, but to protect personnel as well from flying objects and/or fire during such escape.

In certain offshore environments, such as the North Sea or Straits of Magellan, sea conditions are so harsh that an escape system which terminates at a buoy in the water (see. e/g., the aforenamed U.S. Pat. No. 3,880,254), results in an escape route which is akin to "jumping out of the frying pan into the fire." It is therefore, desirable to provide an escape system which terminates on the deck of the rig such that personnel using the escape system will not be exposed to further injury upon impact. This requires a system in which descent conditions are carefully controlled.

It is an object of the invention to overcome the inefficiencies which have existed in safety systems for drilling rigs to deliver personnel from a dangerous position to a safe position remote from the drilling rig derrick.

It is a further object to deliver those personnel working on the derrick of an oil drilling rig, and in particular those drilling rigs used for offshore drilling, quickly and efficiently from the area of the derrick on which they are working to a safe position remote from the derrick on the platform of the drilling rig.

It is still another object of the invention to provide a personnel capsule located adjacent the racking board level for allowing personnel at that level to be removed from the derrick immediately to avoid injury due to blow-out or other imminent danger. The capsule is integrated with a system for releasing the capsule from its position adjacent the racking board level and moving it quickly to a position on the platform of the drilling rig sufficiently remote from the racking board level to avoid any danger which exists in the vicinity of the derrick.

It is another object to provide an assembly for pivoting a personnel capsule away from the derrick of an oil drilling rig and lowering that capsule to a predetermined safe position on the platform of the rig remote from the derrick to provide a means for quickly and efficiently removing personnel away from imminient danger.

Another object of the invention is to control the rate at which a capsule or other personnel carrier is moved away from an oil derrick when personnel on the derrick are being delivered to a position remote from the derrick to avoid injury as a result of a blow-out or other imminent danger.

It is still another object to move a personnel carrier away from an oil derrick and lower the carrier to a platform at a safe position remote from the derrick at a controlled rate of speed.

It is a further object to include a release mechanism operable from within a capsule located adjacent the oil derrick of an oil drilling rig for releasing the capsule from that position adjacent the derrick for allowing the capsule to be moved quickly away from the derrick and delivered to a position sufficiently remote from the derrick to avoid injury which may occur as a result of blowout or other dangerous situations.

It is also an object to incorporate a pneumatic system for actuating a release mechanism which is operable from within a personnel capsule located adjacent the oil derrick of an oil drilling rig for releasing the capsule from the derrick.

It is a further object of the invention to provide a unique linkage system used in conjunction with a capsule or other personnel carrier and the structure connecting the capsule to a means for delivering the capsule from a position adjacent the oil derrick to a remote position away from the derrick to avoid injury to personnel therein. The linkage system is one which allows for some movement of the connecting structure once the capsule has been deposited in a predetermined position without damage to the capsule itself.

It is also an object to control the pendulum effect on the capsule as it is being lowered to prevent the capsule from inadvertently swinging back into the derrick during descent.

These and other objects will become more apparent from the detailed description of the preferred embodiment and the claims which follow hereinafter.

SUMMARY OF THE INVENTION

Generally, the invention relates to an efficient method and apparatus for delivering personnel a sufficient distance away from an oil drilling structure so that where a dangerous situation arises on the structure, such as a blow-out, the personnel can immediately be removed to a safe position out of range of the danger to prevent unnecessary injury of any personnel on the structure.

More specifically, as discussed in connection with the preferred embodiment, the apparatus includes a mechanism for pivoting a personnel capsule away from an oil derrick in the event of a blow-out. The mechanism is characterized by an A-frame structure having a pivot end pivotally secured to the bottom portion of the derrick and a distal end displaced therefrom carrying the personnel capsule. The A-frame structure is maintained in its normal position by a releasable mechanism to hold the A-frame in an unbalanced disposition adjacent to the derrick so that the A-frame will naturally rotate away from the derrick under the force of gravity when released. The speed with which the capsule is pivoted away is controlled by the use of a winch in combination with an hydraulic system. A running wire having one end secured to the A-frame is wound about a winch, which is integrated with the hydraulic system such that the wire is peeled off the winch at a controlled rate. Accordingly, the rate of movement of the A-frame is ultimately a function of the speed at which the running wire is peeled off the winch.

The capsule is secured to the derrick for easy access by the workers who will have to use the capsule to escape should that become necessary. The escape mechanism is actuated by release means inside the capsule so that the personnel can simply enter the capsule and pull the release mechanism to initiate movement of the A-frame. Upon release, the A-frame swings outwardly away from the derrick and causes the capsule to be lowered to a predetermined position.

More specifically, the bottom of the A-frame is pivotally secured to the drilling rig at the racking board level. The top of the A-frame apex, when in the secured position, is nearer the crown of the rig than the bottom of the A-frame. The frame is maintained in a slightly angular position to the vertical so that it will readily rotate away from the rig under the action of gravity when the release mechanism separates the A-frame from the drilling rig.

To prevent the A-frame from rotating beyond the horizontal, a back stay assembly is secured to the A-frame apex connecting it to the derrick. This back stay assembly includes a guy wire having one end connected to the A-frame apex and the other end secured to a shock absorber which, in turn, is fixed to the derrick. The shock absorber is attached to the guy wire to absorb the shock forces imparted to the guy wire when it reaches its full extension. With this configuration, when the boom is released, the A-frame assembly will rotate at a predetermined rate away from the rig until it reaches a horizontal position where it will be stopped by the guy wire.

The capsule is located at the racking board level between two legs of the A-frame preferably at approximately the level at which the legs are rotatably secured to the drilling rig. The apex of the A-frame carries a sheave rotatably secured thereto about which the running wire is wrapped and attached to a link which ultimately connects the wire to a rigid capsule hanger spar which carries the personnel capsule. A shroud at the apex of the A-frame has track members which cooperate with a roller assembly secured to the hanger spar to define a path of movement of the capsule away from the A-frame as the A-frame is pivoted from the drilling rig. In this manner, the capsule maintains its vertical disposition even though the A-frame moves through an arc of up to about 90° or so. However, once the A-frame reaches a horizontal position defined by the length of the back stay guy assembly, the running wire continues to be paid out from the winch allowing the capsule to move downwardly relative to the A-frame to a predetermined position on the platform of the drilling rig.

In this way, where a blow-out, or other dangerous situation exists at the racking level, the personnel there can simply enter the capsule, pull the release mechanism, and thereby be moved at a controlled rate of speed to a predetermined position a substantial distance away from the racking level to avoid injury.

BRIEF DESCRIPTION OF THE DRAWINGS

FIG. 14 is a fragmentary view of the escape pod release mechanism as shown in FIG. 2 in a released disposition.

FIG. 14*a* is a fragmentary view of the escape pod release mechanism of FIG. 14 showing the spring loaded shaft.

FIG. 14*b* is a rear view of the mechanism of FIG. 14 with a portion of the capsule cut away.

FIG. 14*c* is a fragmentary top view of the release mechanism of FIG. 14 with a portion cut away.

FIG. 15 is a top-cross-sectional view of the winch assembly.

DETAILED DESCRIPTION OF THE PREFERRED EMBODIMENT

Figures 1, 10:
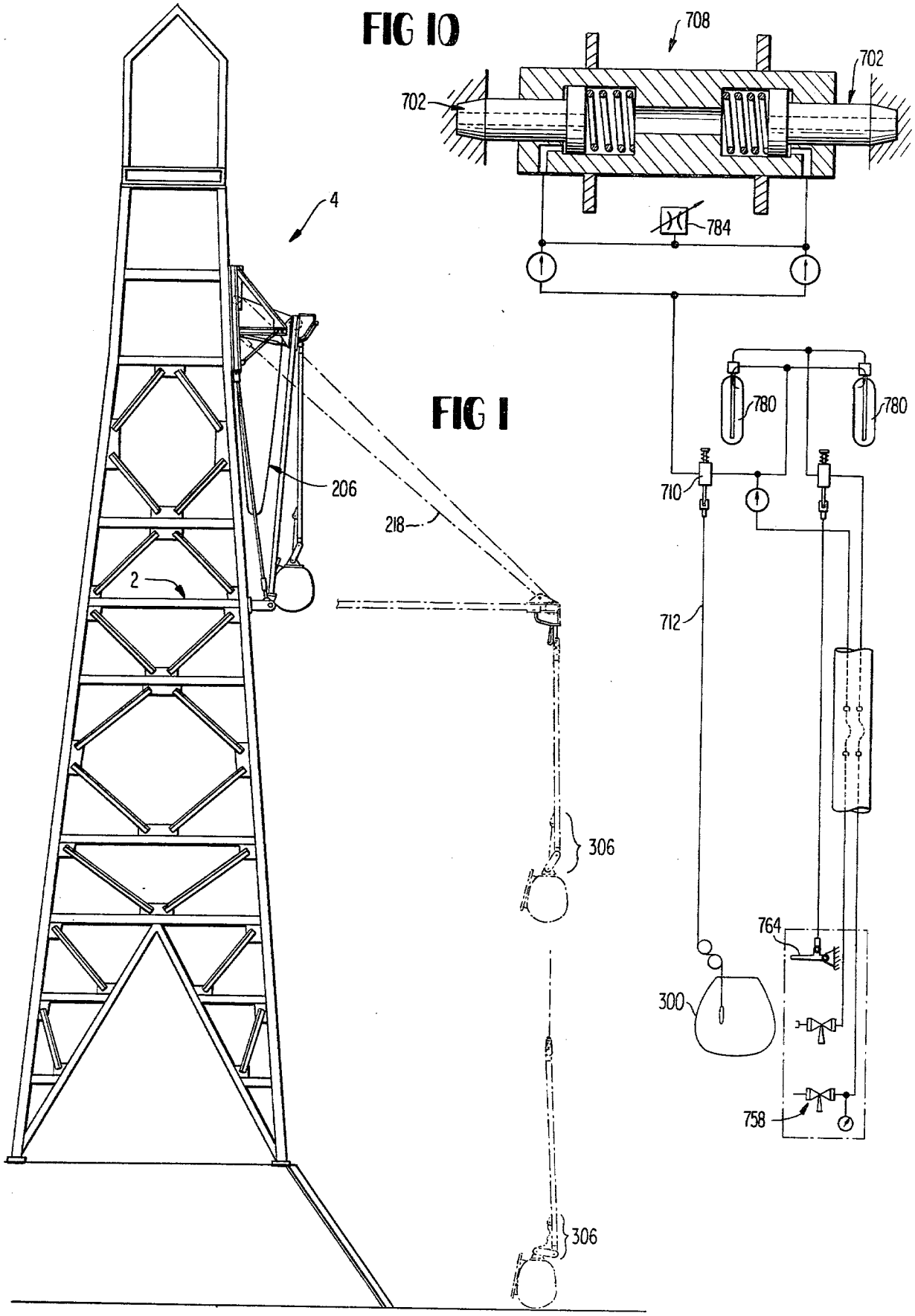
FIG. 1 shows a platform and derrick incorporating the derrick escape system.
FIG. 10 is a schematic of the pneumatic system incorporating the release mechanism.
Figure 13:
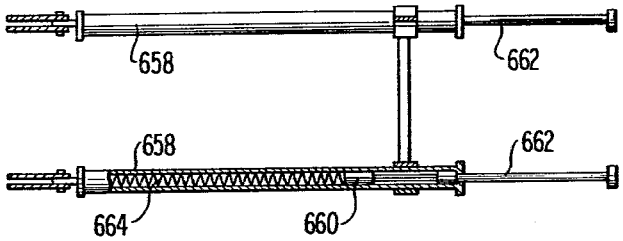
FIG. 13 is a fragmentary top view of the kick-off assembly shown in FIG. 1.

Referring to FIG. 1 there is shown generally, the oil derrick on a drilling platform of the type particularly used for offshore drilling. At the racking board level 2, on the oil derrick there is a provision for personnel to control the stacking of pipes used in the oil drilling procedure. If a blow-out occurs, it is necessary for personnel at the racking board level to leave immediately because of the dangerous situation that exists, particularly in that area. Hereinafter described in detail is the apparatus used for delivering personnel at the racking board level quickly and safely to a predetermined position on the platform, thereby avoiding unnecessary injury because of blow-out or other dangerous situations which may occur in the vicinity of the derrick.

Figure 2:
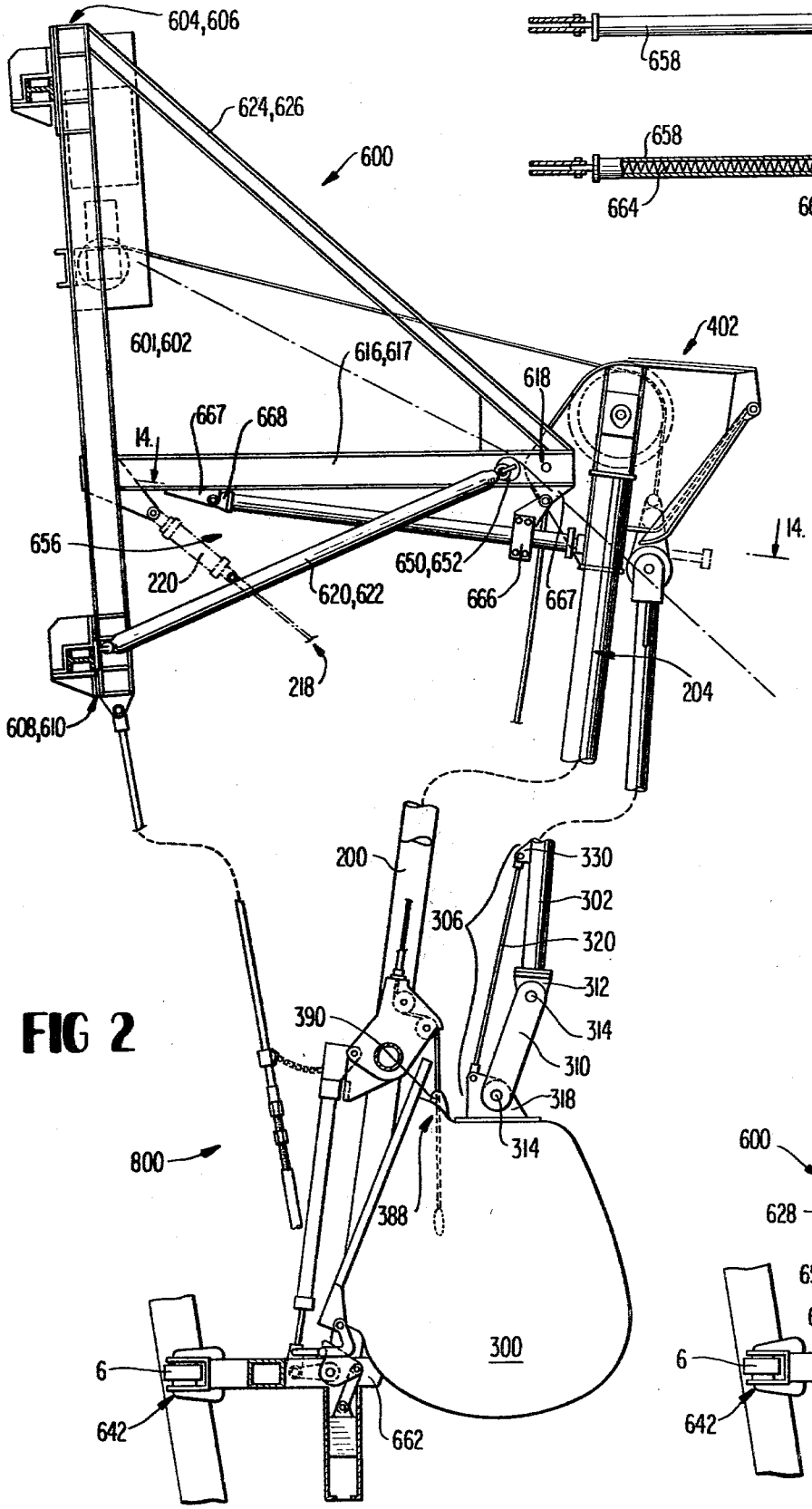
FIG. 2 shows an enlarged side elevation of the derrick and escape assembly shown in FIG. 1.
Figure 3:
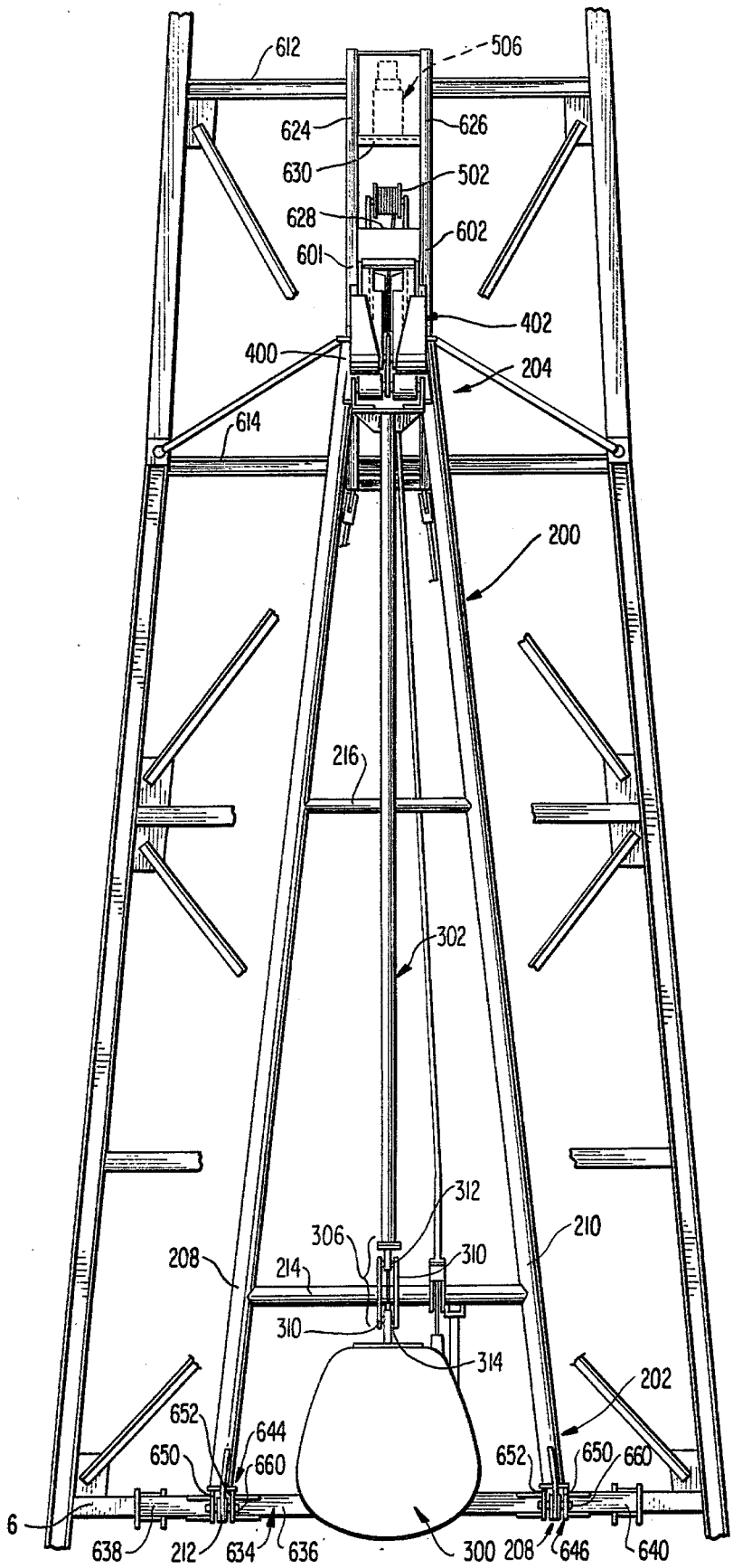
FIG. 3 is a front elevation of the escape system as shown in FIG. 2.
Figure 6:
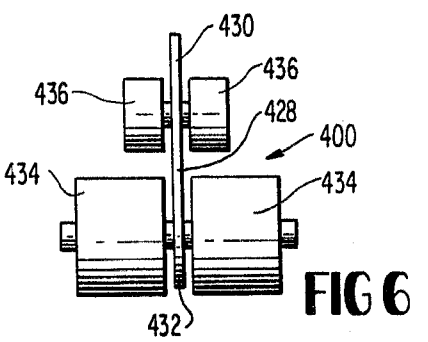
FIG. 6 is a fragmentary detail of the roller assembly shown in FIG. 5.
Figure 7:
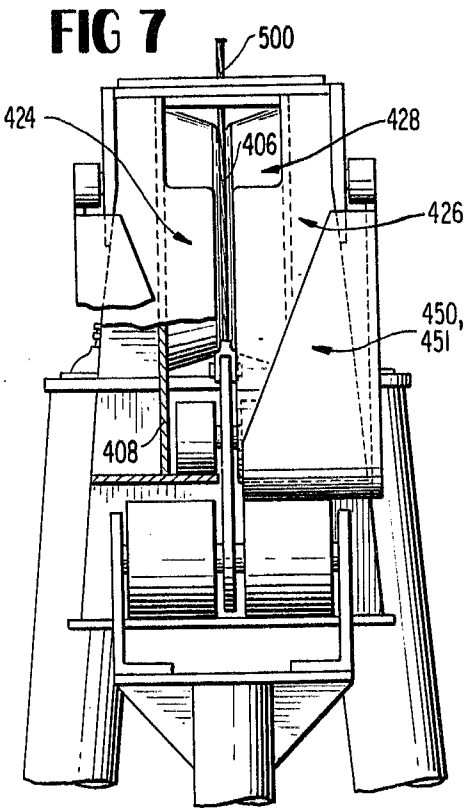
FIG. 7 is a partial elevation without details along lines 7—7 of FIG. 5 showing the front portion of the shroud.
Figure 5:
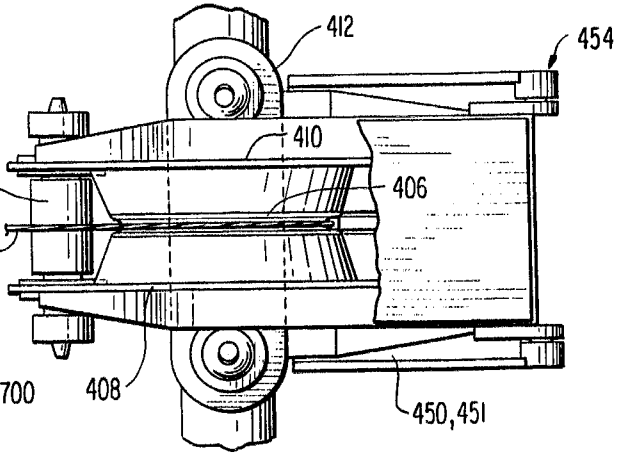
FIG. 5 is a side elevation of the shroud assembly shown in FIG. 4.
Figure 5:
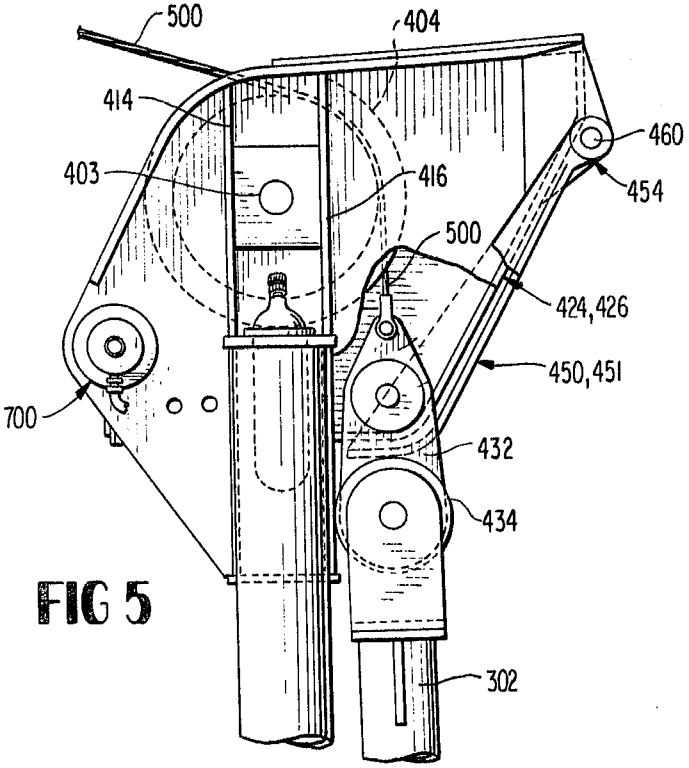

In referring to FIGS. 1, 2 and 3, there is shown generally, the escape system apparatus for allowing the personnel on the racking board level to escape quickly from the oil derrick 4, in case of danger. The escape system includes an A-frame assembly 200 having a pivotal end 202 pivotally secured to the derrick 4 and a distal end 204 carrying a capsule 300. The A-frame assembly 200 is maintained in an unbalanced position so that it will naturally pivot away from the oil derrick 4 under the action of gravity when it is released from the derrick 4. As shown in FIG. 2, this unbalanced position is achieved by securing the A-frame assembly 200 at an angle to the vertical away from the oil derrick 4. Preferably, this angle is on the order of about $7° \pm \frac{1}{2}°$; such design allows for a permissible vessel pitch of about 3°, while retaining sufficient moment to permit proper operation. A pair of kick-off springs, described in detail below, are provided to give the A-frame a positive starting force when the release mechanism is actuated.

The capsule 300 is secured to the distal end 204 of the A-frame assembly 200 through a capsule hanger spar 302 which is pivotally secured at its lower end 304 to the top of the capsule 300 by a hanging spar collapsing link assembly 306 which will be explained in more detail later in this description. The distal end 204 also carries a shroud 402 which houses sheave 404 having a groove 406 about its periphery. A running wire 500 is wrapped through the groove 406 with one end connected to the roller assembly 400 and the other end wound about a winch 502 supported on the derrick 4. The winch 502 is integrated with a hydraulic system 504 to control the rate at which the wire 500 can be paid off the winch 502. Consequently, when the system is actuated, the running wire 500 will be paid off the winch 502 at a controlled rate to ultimately control the rate of movement of the A-frame 200 from the derrick 4 and the descent of the capsule 300 to a predetermined location on the platform.

A back stay guy assembly 206 is fixedly secured to the derrick 4 and the shroud 402 to limit the movement of the A-frame 200 beyond the horizontal. As can be seen in phantom lines in FIG. 1, once the A-frame 200 has reached this position, the running wire 500 is continued to be paid out allowing the capsule 300 to descend vertically from the distal end 204 of the A-frame 200 to the predetermined location where the personnel may leave the capsule 300 in safety.

The above has been a brief description of the various elements or assemblies which comprise the preferred embodiment. This brief description should aid in understanding the more detailed description of the operation of the escape system which follows.

Figure 2D:
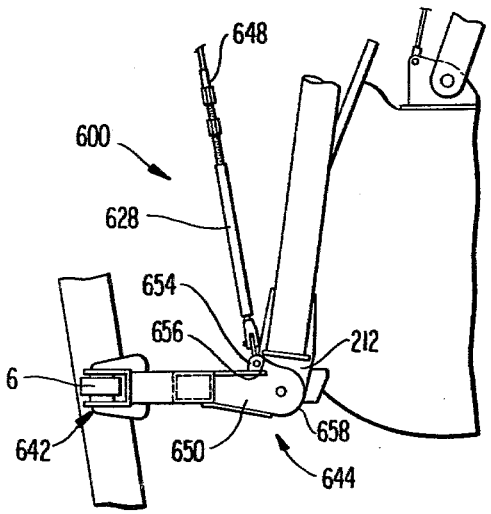
FIG. 2*d* shows the capsule in a docked position adjacent the derrick.
Figure 2C:
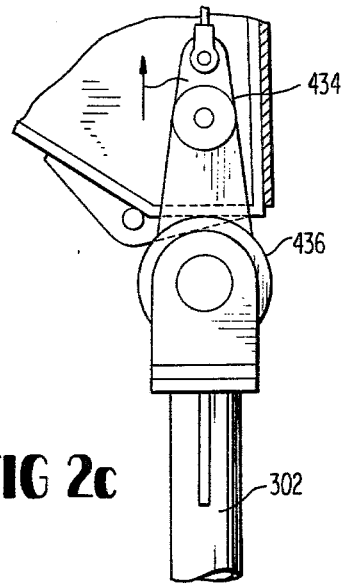
FIGS. 2*a*, 2*b*, and 2*c* show enlarged partial views of the shroud assembly at various positions as it is rotated away from the derrick.
Figure 12:
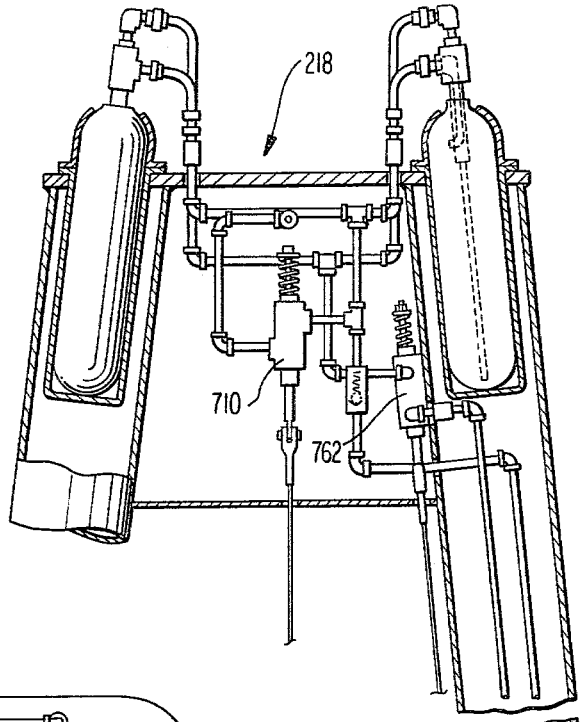
FIG. 12 is a top view of the system shown in FIG. 11.
Figure 12:
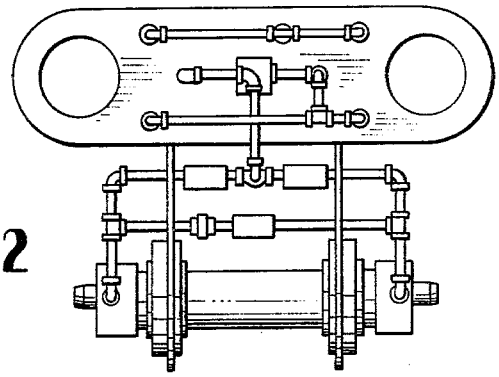

To support the A-frame assembly 200 in its unbalanced position, a support frame 600 is secured to the derrick as can be seen in FIGS. 2 and 2*d*. The support frame 600 has two parallel upright beams 601,602 each secured at its top portion 604,606 and bottom portion 608,610 to cross members 612,614 on the derrick 4 in any convenient manner. Extending laterally from these cross members 612,614 are lateral beams 616,617, to the outer ends 618 of which the shroud 402 is releasably secured. A pair of adjustable pipe strut supports 620,622 extend angularly from the bottom portions 608,610 of the upright beams 601,602 to the outer ends 618 of which the shroud 402 is releasably secured. Similarly, a pair of upper "I" section supports 624,626 extend angularly from the top portions 604,605 to the outer ends 618 of the lateral beams 616,617. These angular supports provide sufficient strength to the lateral beams 616,617 and the remainder of the support frame 600 to withstand the loads imparted by maintaining the A-frame assembly 200 in an unbalanced position and in lowering and raising the capsule 300.

Figure 8:
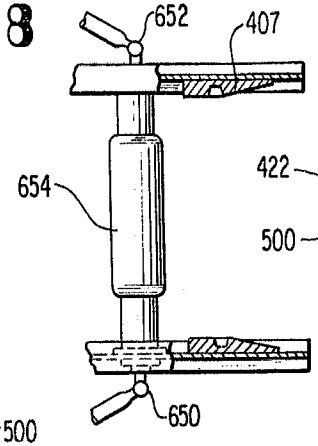
FIG. 8 is a top plan view of FIG. 5 with the top of the shroud broken away.
Figure 4:
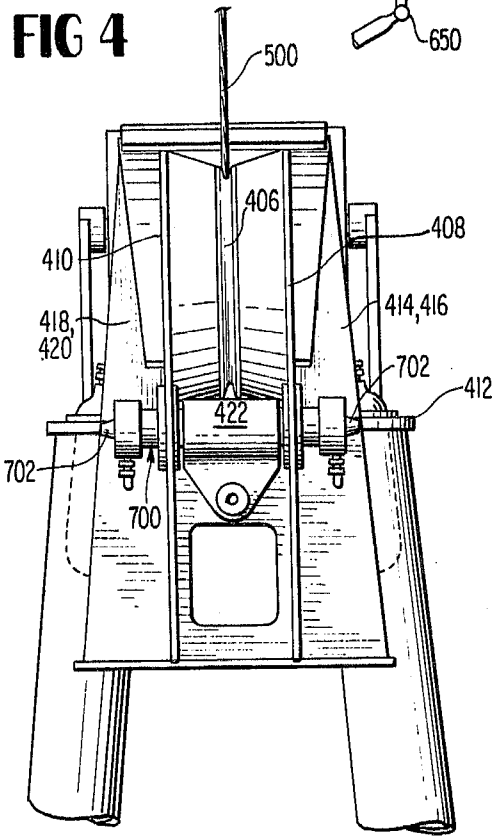
FIG. 4 is a front elevation of the shroud assembly taken along lines 4—4.
Figure 9:
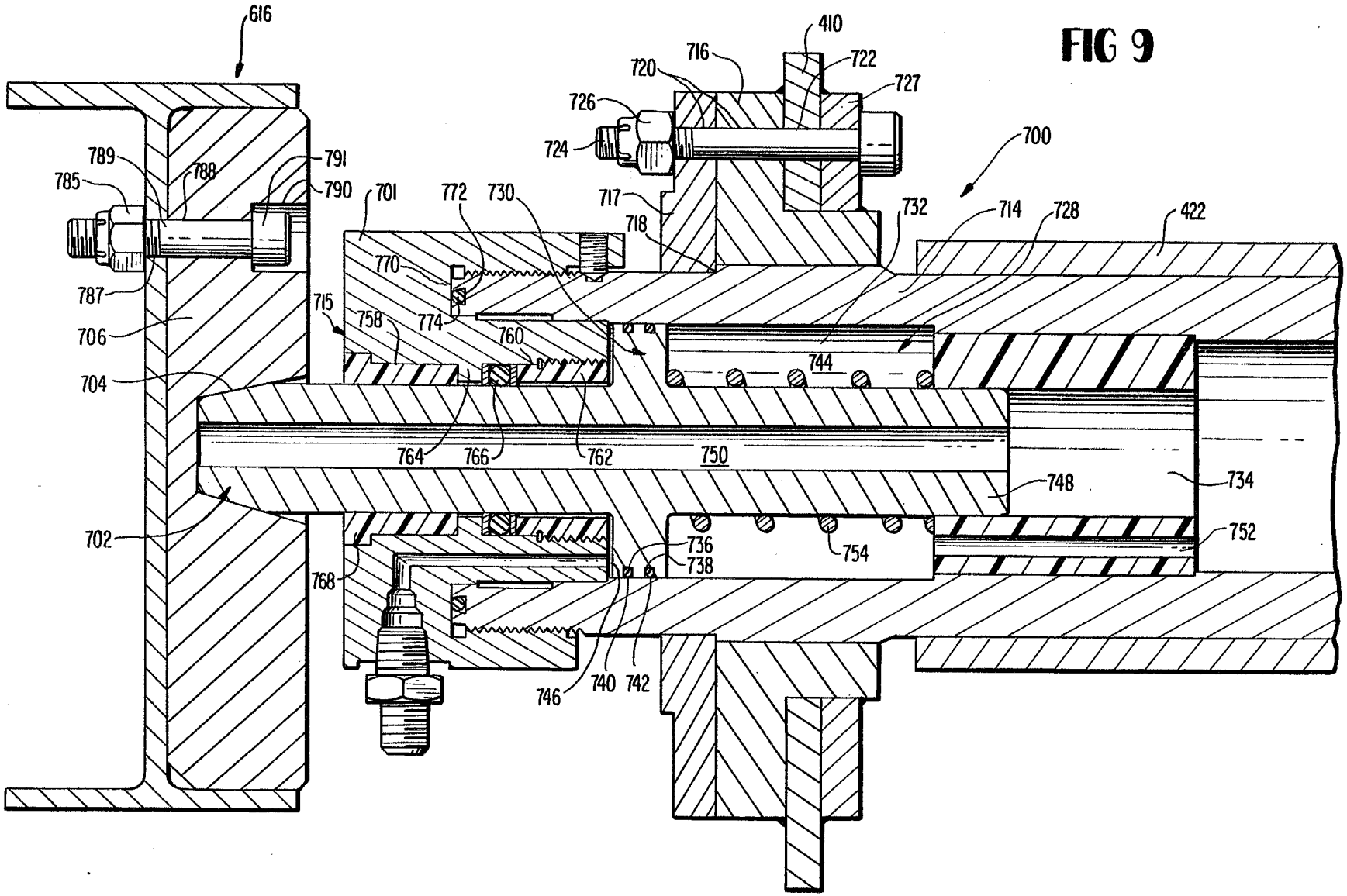
FIG. 9 is an enlarged cross-sectional view of the pneumatic release mechanism.

Adjustable pipe strut supports 620,622 are used in conjunction with the support frame assembly to give additional support to the extended beams as shown in FIG. 8. These adjustable pipe supports 620,622 have one end universally connected directly to derrick cross member 614 with the upper end connected through universal joints 650,652 to a roller bar 654. The roller bar 654 provides tie support for the free ends of lateral beams 616,617 as well as a surface over which the running wire 500 moves as it is being paid out during movement of the A-Frame assembly 200 away from the derrick 4 and lowering the capsule 300 to its predetermined location. This roller bar 654 will rotate under the moving pressure of the running wire 500. As can be seen from the Figures, particularly 2 and 8, the running wire 500 is maintained in a substantially straight line between the sheave 404 and the winch 502 as the A-frame assembly 200 is pivoted away from the derrick 4. A hydraulics support package 630 is located above the wince 502 and contains a hydraulic fluid reservoir 506 and other parts of the hydraulic system 504 used in connection with the winch 502, including the hoisting pump motor which is also integrated with the winch 502 in a manner which will be explained in more detail hereinafter.

A kick load bar 634 is located on the lower part of the derrick and extends outwardly from the derrick 4 to provide a means to which the A-frame assembly 200 is pivotally secured. Reference should now be made to FIGS. 2, 2*d* and 3 in connection with the following discussion. The kick load bar 634 is a transverse beam 636 having a length greater than that between the bottom of the legs 208,210 comprising the A-frame assembly 200. The ends 638,640 of the kick bar 634 are fixed to cross member 6 on the derrick 4 by C-clamp assembly 642 which can be bolted or otherwise secured in place in any convenient manner. Extending outwardly from this kick bar 634 are two spaced-apart plate flanges 644,646 which provide means for securing the one end of a tension rod 628 and for pivotally receiving the legs 208,210 of the A-frame assembly 200. Each of the flanges 644,646 includes flange portions 650,652 having an upper boss 654 which carries a pin 656 to which the one end of the tension rod 648 is secured. A lower boss 658 extends outwardly beyond the upper boss 654 away from the derrick and also carries a pin 660 between the flange portions 650,652 which is pivotally engaged by a lug 212 on the lower end of the legs 218,219 of the A-frame assembly 200. The tension rods 248 extend between the kick load bar 634 and the bottom portion of the upright members 601,602 to transfer some of the loads imparted to the kick load bar 634 by the A-frame assembly 200. The kick load bar 634 also carries a seat 662 on which the capsule 300 rests adjacent the racking level for easy access by the personnel in that area.

The A-frame assembly 200 is more clearly shown in FIG. 3. There it can be seen that the A-frame assembly 200 includes two legs 208,210 spaced apart, each leg being pivotally secured to the oil derrick 4 along a common axis displaced from each other at the pivotal end. Each leg has a pivot lug 212 which is pivotally secured to the pins 660 on the kick load bars. The legs 208,210 extend toward each other from the pivotal end 202 to the distal end 204 and are connected at the distal end or apex to form the A-frame configuration. The legs 208,210 in addition, are secured to each other by cross members 214,216. In this way, a rigidity and stability is achieved for the A-frame structure in pivoting it away from the oil derrick and carrying the capsule to a safe location.

The shroud 402 referred to earlier provides a means for attaching the guy wire and also securing the hanger spar 302 thereto. Reference should now be made to FIGS. 4, 5, 6, 7, 8, 9, and FIGS. 2*a–b*, where details of the shroud 402 and related structure are shown. The shroud 402 includes sheave support plates 408,410 spaced from each other in parallel disposition. The upper portion of these support plates carries a shaft 403 which rotatably supports the sheave 404 so that it can rotate about the shaft 403 as running wire is moved in the groove 406 of the sheave 404. It should be noted that every portion of the sheave 404 advantageously falls within the outermost dimension of the support plates 408,410. Although not essential, this provides protection for the sheave 404 as well as the wire. To secure the sheave support plate 408,410 in position, there is provided a frame connecting member or plate 412 which extends from the top of each leg of the A-frame assembly 200 to the plates 408,410 to fixedly locate the plates midway between the legs. Other annular plates, 414,416,418 and 420 are secured to the plates 408,410 and connecting member 412 to provide structural support as shown.

The rear portion of the plates carry between them a sleeve 422 to which is attached one end of the guy wire 218. The other end of the guy wire 218 is attached to a shock absorber 220 connected to the uprights 601,602 adjacent the lateral beams 616,617. The shock absorber 220 may be of the spring type, a piston and cylinder type or any convenient absorber so long as it absorbs the shock forces imparted as the result of the A-frame assembly 200 being stopped at the horizontal position. Another embodiment could include the use of counterweights to offset the force of gravity. In addition, the back stay guy assembly 206 need not be entirely of wire; a rigid member may be used in conjunction with the wire to avoid entanglements, whipping actions, and other problems associated with using wire alone.

The front portion of the shroud 402 has extending from the plates 408,410 two tracks 424,426 defining a path across an arc of approximately 90°. These tracks 424,426 are engaged by the roller assembly 400 to define the path of movement of the capsule relative to the A-frame assembly 200 as it is pivoted away from the derrick 4. The roller assembly 400 has a link 428 with an upper end 430 and a lower end 432. The upper end 430 is secured to one end of the running wire 500 while the lower end carries bottom rollers 434 and is also pivotally connected to the upper portion of the hanger spar 302. Intermediate the bottom rollers 434 and upper end 430 are top rollers 436 which are smaller than the bottom rollers 434. The link 428 is a plate-like member with the bottom and top rollers 434,436 each having a roller on either side of the link 428. The tracks 424,426 are separated from each other to define a path through which the link can pass as the roller assembly 400 moves down the tracks 424,426.

As can be seen from FIGS. 2*a*, 2*b*, 2*c* and 5, the bottom rollers 434 engage the tracks 424,426 from the underside, and the top rollers 436 engage the track 424, 426 from the upper side. In this way, the tracks 424,426 extend between the top and bottom rollers 434,436 to maintain the roller assembly 400 secure to at least some part of the tracks 424,426. The winch 502 cannot pull the assembly 400 upwardly relative to the A-frame because of the engagement of the bottom rollers 434 with the tracks 424,426 nor can the weight of the capsule pull the assembly 400 downwardly because of the engagement of the top rollers 436 with the tracks 424,426. At the end of the tracks 424,426, however, there is an opening 428 large enough to allow the passage of the top rollers 436 but insufficient in size to allow the passage of the larger bottom rollers 434. Thus, the only relative movement of the capsule 300 to the shroud 402 is along the path defined by the tracks 424,426 until the roller assembly 400 reaches the opening 438 at the end of the assembly. At this point, the capsule 300 may be lowered vertically relative to the shroud 402 because of the disengagement of the top rollers 436 from the tracks 424,426.

With the above configuration as the A-frame 200 moves away from the derrick 4 so also does the hanger spar move away from the A-frame 200 pivoting away from the A-frame along the path defined by the tracks 424,426. Also, the spar maintains a vertical position by reason of the pivot connection to the lower roller set. This maintains the capsule 300 in a vertical disposition during the entire movement of the A-frame 200. See FIGS. 2*a*, 2*b*, 2*c*. Once the A-frame 200 has reached the horizontal position, so also has the roller assembly 400 reached the opening 438 where the roller assembly becomes disengaged allowing the capsule to descend vertically from the A-frame 200. Upon retraction, rewinding of the running wire 500 will pull the capsule upwardly until the larger bottom rollers 434 engage the track. Because these bottom rollers 434 cannot move through the opening, continuing the winding of the running wire will cause the A-frame 200 to be pivoted back toward the derrick 4. During this retraciton the roller assembly follows a path in the reverse to the path along the tracks 424,426 it took when the assembly was being pivoted outwardly away from the derrick.

The engagement described above of the bottom wheels 434 with tracks 424,426 is the case where guide means are not used to position the wheels for retrieval. To ensure that the capsule 300 is retrieved properly when returning the capsule 300 and the A-frame assembly 200 to its normal position, guide means are included to guide the capsule 300 toward the gap 428. This ensures that the top set of rollers 436 will pass through the opening 428 allowing the bottom set of rollers 434 to travel rearwardly on a path defined by the tracks 424,426 as the A-frame assembly 200 is returned to its normal position. This guide means includes spar roller aligning plates 450,451 provided on either side of the shroud 402. Since each one of the aligning plates are identical in configuration the following description will be directed to only one of the plates for purposes of disclosure.

The roller aligning plate 450 includes a flared end 452 and a hinge end 454 hingedly secured to the shroud 402 adjacent the opening 428. The hinge end 445 and the flared end 452 are connected by a guide plate 456 which provides the major portion of the plate 450 engaged by rollers 434,436.

Figure 2A:
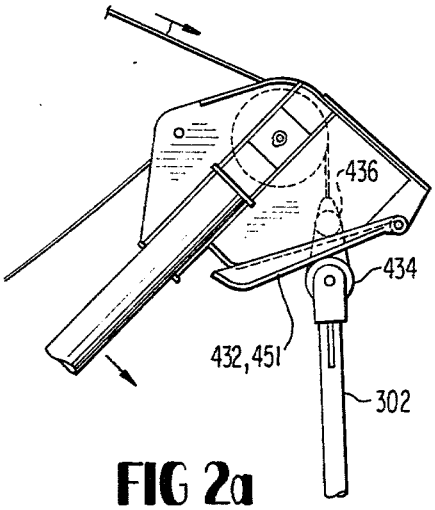
Figure 2B:
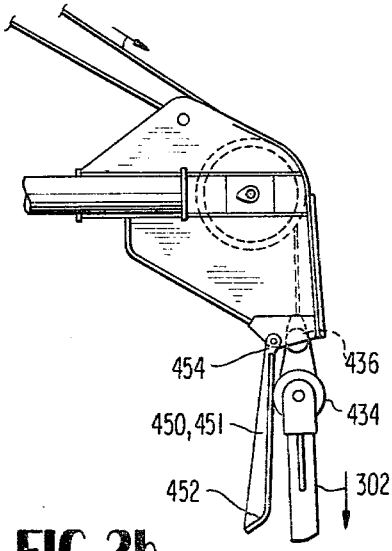

The remaining portion of the aligning plate 450, i.e., the flared end 452 and the guide plate 456, are configured substantially identical to the surface of the tracks 424,426. This configuration allows the aligning plate 456 to fit snugly over the tracks 424,426 when the A-frame assembly 200 is in the retained position adjacent the derrick 4 as can be seen in FIG. 2. On the other hand, when the shroud reaches its fully extended position the aligning plate 450 will pivot about the axis defined by hinge pins 460 to assume a substantially vertical position as shown in FIG. 2*b*. The plate 450 remains adjacent the tracks 424,426 so long as the rollers 434,436 are moving along the path defined by these tracks because of the continuous engagement of the bottom roller 434 with the plate 450. However, when the upper roller assembly reaches the opening 428, the bottom rollers 434 disengage the plate 450 allowing it to swing naturally under the force of gravity to the vertical position discussed above.

With the above-described configuration, the aligning plate 450 will guide the roller assembly 400 into the proper position relative to the opening 428 upon retrieval of the capsule. Specifically, aligning plate 450 will aid in guiding the top rollers 436 through the opening 428 overcoming the effects of wind and other elements which may tend to cause misalignment.

In operation, the aligning plates 450 cooperates with tracks, 424,426, the roller assembly 400 in the following manner. After the A-frame assembly 200 is released and moves away from the derrick 4, the top rollers 436 move down the path defined by tracks 424,426. During this period the aligning plate 450 is continuously restrained from movement by the lower rollers 436 as can be seen in FIG. 2*a*. Upon reaching the gap 428 the roller assembly 400 will move downwardly away from the shroud 402 effecting disengagement of the lower roller 434 from the aligning plate 450 thereby allowing the aligning plate 450 to pivot away from the tracks 424,426 to the vertical position shown in FIG. 2*b*.

It is in this vertical position that the aligning plate 450 serves its aligning function. As the capsule is being retrieved, it may be subjected to wind currents or other elements causing the roller assembly 400 to be misaligned with the opening 428 As the roller assembly is drawn toward the opening 428, the rollers 434,436 will initially engage the flared end 452 which directs the wheels into proper alignment. This alignment is maintained by the guide plate 450 until the bottom roller 434, which as discussed above, cannot pass through the opening 428, reaches its maximum upward movement relative to the shroud 402. Continuation of the retrieval process results in the movement of the roller assembly 400 back along the tracks 424,426 in the opposite direction taken by assembly 400 described above when the A-frame assembly 200 is lowered. This of course, returns the aligning plate to a position adjacent the tracks 424,426.

Except for the reservoir 506, the hydraulic system 504 is not shown in detail, since it is a standard item well known to those skilled in the art. However, a redundant system is incorporated with the winch 502 for safety purposes. Shown schematically in FIG. 15 are two motors 404*a* and 504*b*, which are on either side of the winch 502 to provide means for controlling winch speed should one motor 504*a*,504*b* become damaged.

The hydraulics system 504 is one which maintains the rotation of the winch 502 at a constant rate regardless of the load on the capsule. The running wire can be paid out at a speed in the range of 4 FPS to 15 FPS with 9 FPS being preferred, whether one or more personnel are in the capsule 300 when it is released, to pivot the A-frame assembly 200 and lower the capsule 300 at a controlled rate of speed. Once the weight on the wire 500 is removed, when the capsule 300 is deposited, the winch stops and the wire is no longer peeled off.

Because the capsule hanger spar 302 may continue to travel a short distance once the capsule has been deposited on the platform, a spar collapsing assembly 306 is included between the top of the capsule and the spar 302 to prevent spar 302 from continuing its motion downwardly and possibly damaging the capsule itself. As can be seen in FIGS. 2 and 3, this linkage assembly 306 includes capsule links 310 each having one end rotatably secured to the bottom portion of the spar 302 and the other end pivotally secured to the top of the capsule. The links 310 are spaced in parallel disposition to each other, and at each end of the links 310, pins 312,314 are secured to the links 310 to maintain them in this space parallel disposition. The bottom of the spar has a spar lug 316 journaled about pin 312; similarly, the capsule 300 defines a capsule lug 318 which is journaled about pin 314. It is in this manner that the links 310 join the capsule 300 to the spar 304.

The adjusting wire 320 is also secured between the capsule 300 and the spar 302. The length of the wire 320 may be made adjustable by any convenient means known to those skilled in the art. This would include the use of a threaded rod threadedly secured to an adjustable nut. An angular flange 330, is located on the spar 302 above spar lug 316. One end of the adjusting wire 320 fastened to lug 318 and the other end of the adjusting wire is fastened to the angular flange 330 to support the capsule 300 when it is being lowered to the predetermined position on the platform. The length of the adjusting wire 320 is somewhat less than the sum of the lengths of the link and the portion of the spar between the angular flange 330 and the spar lug 316. In this way, the spar 302 is maintained in offset disposition as can be seen in FIG. 1. As a result, once the capsule 300 has reached its position on the platform and the spar 302 continues to move, the interaction of the links 310 and the adjusting wire 320 will cause it to move or pivot away from the capsule 300 as shown by the phantom lines. As the rigid assembly moves away from the capsule, slack will be imparted to the adjusting wire. The amount of offset is controlled by simply changing the length of the wire 320 by adjusting the means employed for this purpose.

The release mechanism is one which maintains the A-frame assembly 200 in its unbalanced position relative to the derrick 4, secured to the derrick 4 until released by the personnel who have entered the capsule 300. As can be seen in FIGS. 4, 8, 9 and 10, the release mechanism includes an air poppet device 700 having two release pins 702 which engage apertures in retainer blocks 706 carried in lateral beams 616,617. This poppet 700 is operated by a pneumatic system 708 actuated by a valve 710 which is placed in operation when the personnel in the capsule pull a release lanyard 712 which is secured to the valve 710 at one end and is connected to a convenient actuator within the capsule 300. For the purposes of discussion, only one side of the pin actuating mechanism will be described since the other side is configured and operates in the exact same manner. The poppet housing 714 is located within the sleeve 422 and the shroud 402 for interaction with the apertures 704 in the support frame 600. The poppet 700 includes a cylindrical housing 714 with a flange 716 circumscribing the housing 714 for securing the poppet to a portion of the shroud 402. The housing 714 further includes an offset portion 718 for cooperating with a retaining flange 717 which is placed about the offset portion 718 to secure the poppet 700 in place. The flanges 716,717, have a series of bolt holes 720 around the periphery which register with the corresponding holes 722 in the shroud 402 such that bolts 724 can be placed entirely through all the holes 720,722 when properly aligned to secure the retaining flange 716 against the shroud 402. An elastic stop nut 726 is threaded onto the bolts to hold them in place.

The poppet housing 714 includes a hollow cylinder 728 for defining the path of movement of a piston 730 which, in turn, carries the pins 702 for operation with the apertures 704 in the support frame assembly 600. The cylinders 728 are coaxial with the axis of the poppet housing 714 and define two portions for operating with the piston and maintaining the piston in the proper alignment. The first portion of the cylinder 728 is a large cylinder 732 closer to the end 715 of the housing 714 and is of a larger diameter than the second portion of the cylinder 728 which is a guide cylinder 734 extending from the opposite end of the large cylinder toward the center of the poppet housing 714. The piston 730 has an outer diameter slightly less than the diameter of the large cylinder 732. This piston 730 has two peripheral grooves 736,738 about its outer surface for receiving sealing rings 740,742. In this manner, the piston defines a first cavity 744 and a second cavity 746 on either side thereof which are substantially sealed from one another. The interaction of the piston 730 with the cylinder walls of the large cylinder 732 are such that the piston 730 can move back and forth in a longitudinal direction within the large cylinder 732 as a function of the pressure on either side of the piston 730. Extending from the left side of the cylinder as shown, is the release pin 702, which in a normal position, extends beyond the end surface of the poppet 700 well into the aperture 704 defined in the retaining blocks 706. Extending from the right side of the piston 730 is a guide pin 748 which defines an air flow path 750 between the second cavity 746 and guide cylinder 734. The guide cylinder 734 is vented to atmosphere through path 750 in the pin 702.

Also, in the second cavity 746 there is a compression spring 754 which, in the normal position is compressed to force the piston 730 and ultimately press the pin 702 outwardly and into the aperture 704 in the support structure. In operation, when the release mechanism is actuated, air is forced into the first cavity 744 on the left side of the piston 730 until the pressure overcomes the force of the spring 754 inwardly toward the center of the poppet 700. As the piston 730 moves the air within the second cavity 746, the air is compressed and forced through a vent 752 through cylinder 734 to outlet path 750. Once the piston 730 has been moved a sufficient distance to completely withdraw the release pin from the aperture 704, the shroud 402 will be released from the support structure allowing the A-frame 200 to fall away from the derrick 4.

The release pin 702 fits snugly against Micarta sleeves in the poppet 700 to maintain the piston 730 as well as the release pin 702 in the correct longitudinal disposition during the entire movement of the piston 730 back and forth within the large cylinder 732. In this way, the piston 730 cannot be bent out of its correct position within the flange cylinder 732 which could result in the breaking of the seal.

At the left end of the poppet 700, the external portion of the poppet is theaded to engage a correspondingly threaded grommet 701 which holds the Micarta sleeves in place relative to the release pin 702. This grommet includes two annular recess areas 758,760 for receiving and holding the two Micarta sleeves. The first sleeve 762 adjacent the piston 730, as shown is threaded into the grommet 756 and is configured such that a space is provided between one end of the Micarta sleeve 762 and an annular ring 764 between the recess areas 758,760 to receive O-ring 766 for ensuring a seal along the interface between the release pin 762 and the inner surface of the grommet 756. The annular recess region 758 adjacent the end of the grommet receives a second Micarta sleeve 768 which is held in place in any convenient manner. An inner face 770 of the poppet housing 700 defines a groove 772 for receiving an O-ring 774. The O-ring 774 and groove 772 interact with the bottom surface 776 of the grommet 756 to compress and seal the second cavity 746 from the exterior so that leakage will not occur when pressure is imposed on the left surface of the piston 730 and inlet air path 778 is provided in the grommet 756 as shown for charging the second cavity 746 with air when the system is activated. With this configuration, the pins 702 will be moved smoothly back and forth within the cavities of the grommet 756 and poppet housing 714. In addition, all the cavities are properly sealed avoiding any inadvertent leakage of air as the piston 700 is pressurized for release of the A-frame assembly.

The retaining block 706 defines the pin receiving aperture 704 which is slightly flared at the outer face so that when the pin 702 is not directly opposite the center line of the aperture 704 it will be moved into the proper position as the flared surfaces engage the outer surface of the pin 702. Similarly, the outer portion of the left portion of the pin 702 has a truncated cone configuration to aid in camming the poppet 700 into engagement with the pin receiving aperture 704. In addition, the block 706 has cam surfaces 707 as can be seen In FIG. 8 which also aids in locating the poppet in the correct position between apertures 704.

The block 706 includes several bolt holes 788 about the perimeter having recessed regions 790 for receiving the heads 791 of the bolt 789. These bolt holes 788 are registerable with corresponding holes 787 in the support frame 600 to secure the block 706 in place by inserting the bolts 789 through the registered holes 787,788 and threading the nut 785 in place as shown. By having recessed regions 790 for the heads 791 of the bolts 789, no portion of the bolts extends beyond the outer surface of the block. This prevents jamming when the A-frameis released.

A schematic of the pneumatic system for operating the poppet 700 is shown in FIG. 10. There it can be seen that air cylinders 780 are connected to inlet air paths 778 through valve 710 which is maintained in a normally closed state. These air cylinders 780 may be carried in the A-frame 200.

A bleed valve 784 is connected across the inlet paths 778 for bleeding air out of the second cavity 746. A lanyard 712 is attached to valve 710 and is operable from within the capsule 300. When lanyard 712 is pulled, the valve 710 is opened allowing compressed air to flow from the air cylinders 780 into the second cavity 746. This moves the piston 730 inwardly pulling the release pins 702 out of the aperture 704 to release the shroud 402 from the support frame 600 allowing the A-frame to pivot away from the derrick 4.

The bleed valve 784 slowly exhausts the air in cavity 746 to the point where the spring force will eventually predominate returning the pin to its normal extended position. Valve 784 controls the rate of exhaustion to insure that the pin 702 will not be extended until the A-frame assembly 200 has moved well out of the vicinity of the retaining blocks 706. To reset the mechanism the assembly 200 is simply returned to its position adjacent the derrick where the pins 702 can naturally bias into the apertures 704 under the action of the spring 754.

The pressurization system includes several safety features to protect the bottles as they are carried on the A-frame assembly and assure operation of the release mechanism under variable conditions. Each bottle 750 is contained in a casing 752 which is of a fireproof material to insulate the bottles from the heat generated by the fire which often accompanies blow-out. To hold the bottles 750 in place, a flanged crown 754 is employed for engaging the top of the bottle 750 and securing the bottle firmly within the cavity defined by the casing 752. For this purpose, a flange 755 has bolt holes therethrough extending from the periphery of the crown 754 and for securing the flanged crown 754 to the top of the A-frame assembly 200. In addition, the casing 752 is provided with a flange 753 about the casing periphery. The flange 753 has bolt holes registerable with those in the crown flange 755 such that the casing 752 and the crown 754 can be simultaneously secured to the top of the A-frame assembly 200.

A charge line 756 is connected to a charge source valve 758 which is ultimately connected to some sort of pressure source which is not shown herein for charging the bottles 750 should they become depleted. In this manner it is not necessary to continually replace the bottles as they are used or due to leakage. Rather, the fluid under pressure, preferably air, can be forced into the bottle 750 until the desired pressure is achieved from an independent source through the charge source valve 758.

A bleed line 760 is integrated with a bleed valve 762 and an actuator 764. This permits manually opening the valve 762 when desired, in order to drain the tanks of accumulated moisture and/or to check bottle pressure.

Figure 11:
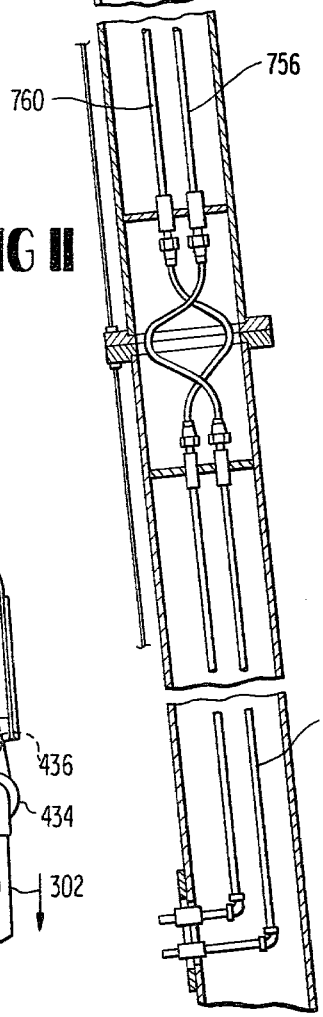
FIG. 11 is a fragmentary view of the pneumatic system used with the release mechanism.

As can be seen in FIG. 11 the major portion of the pipe system is confined within one of the legs 208,210 comprising the A-frame assembly 200. In addition, a large part of the remaining pipe system and operating valves are located in a housing 218 at the top of the A-frame assembly 200 between the two bottles 750. By locating the system as described above, protection from damage is obtained allowing the system to operate in even the most hazardous of conditions.

Means are provided for pushing the A-frame assembly 200 away from the oil derrick in addition to the forces of gravity to ensure that the A-frame assembly is far enough away from the derrick that the forces of gravity will readily pull the assembly downwardly during the escape procedure. Although the forces of gravity will normally allow the system to operate properly, under worse conditions such as a 40 mile an hour frontal wind these forces of gravity simply may not be enough to initiate movement of the system.

Accordingly, a kickoff spring mechanism 656 is included to bias the A-frame assembly away from the derrick in addition to the forces of gravity. This kickoff spring mechanism 656 includes a tube 658 having a piston 660 therein with a rod 662 extending through an open end of the tube 658 and engaging a protion of the A-frame assembly near the apex. A spring 664 is provided within the tube to bias the piston carrying the shaft against the A-frame assembly. The kickoff spring mechanism 656 has a head end 666 rotatably secured to the flange 667 at the end of the extended beams with its rear end 668 rotatably secured to another flange 669 extending from the bottom of the lateral beams 616,617 adjacent the derrick as shown. The pressure of the spring 664 provides approximately 250 to 500 pounds of force acting on the top apex of the A-frame assembly 200 and will extend 36 inches beyond the end of the tube 658 when the A-frame is released to initiate movement away from the derrick 4.

Of course, once the A-frame assembly 200 is moved beyond the 36 inch lengh of the rod in its extended disposition, it will disengage the rod and continue to fall away under the action of gravity as controlled by the running wire 500.

An escape pod release mechanism is incorporated with the capsule 300 to hold the capsule 300 in a position adjacent the derrick 4 at the racking board level. This mechanism ensures the personnel in that vicinity can easily enter the capsule without it being inadvertently disengaged from the derrick 4. Once the release mechanism is actuated to initiate movement of the A-frame assembly 200, the latching mechanism 800 will continue to hold the capsule 300 adjacent the derrick 4 until there has been movement of the assembly 200 through a predetermined arc. This system avoids the inordinate pendulum effect which otherwise might occur causing the capsule to possibly swing back and hit a portion of the derrick 4 during the descent of the capsule 300. In this preferred embodiment, the capsule 300 is maintained in this restrained position during movement of the A-frame assembly 200 through a 1 to 2 degree arc.

The mechanism 800, includes as shown in FIGS. 14, **14*a*, 14*b*, 14*c*, a latching mechanism 802 which is comprised of a cylinder 804 having a piston 806 movable along the path defined by the cylinder walls. A shaft 808 is carried by the cylinder 804 having one end releasably connected to a bell crank 810 and another end extending through the end of the cylinder 804. Pin aperture 812 for receiving a locking pin 814 is provided in the other end of the shaft 808 to register with a complementary aperture 813 in the top portion of cylinder 804 as can be seen in FIG. 14*a*. A spring is maintained in a normally biased disposition between a portion of the cylinder 804 and the piston 806 to bias the piston 806 and ultimately the shaft 808 upwardly against the locking pin 814 when it is located in the locking pin apertures 812,813. With the pin in place through apertures 812,813 the shaft 808 is prevented from upward movement thereby similarly preventing rotation of the bell crank 810. In this manner, when the pin 814 is withdrawn, the shaft 808 will be extended well above the upper end of the cylinder 352, under the force of the spring bias, thus permitting the bell crank 810 to rotate in a clockwise direction as shownin FIG. 17**.

The locking pin 814 is carried on a chain 818 which, in turn, is secured to a cross rod 820 extending between the tension rods. The chain 818 is of a predetermined length such that the locking pin 814 will remain within the pin apertures 812,813 after the rotational movement of the A-frame assembly is initiated away from the derrick. However, once a one to two degree rotation has been achieved, the chain 818 will have reached its full length such that further rotation will result in the locking pin 814 being pulled out of the apertures 812,813. This allows the spring bias to force the piston 806 with its shaft 808 upwerdly which, in turn, permits movement of the bell crank 810 to a position where the capsule 300 is unlatched.

The bell crank 810 includes a hook which in its normal position is sufficiently engaged with latching bale 374 extending from the bottom portion of the capsule to maintain the capsule in a docked disposition adjacent the racking board level of the oil derrick. At one end 381 of the bell crank is rotatably secured a link 370 which links the bell crank with a counterweight 372. The other end 313 of the bell crank is engaged by the bottom of the shaft 808. As can be seen in FIG. 14*c*, the bell crank includes a cross shaft 378 which connects the hook 368 with the end 383 of the bell crank engaged by the bottom of the shaft. This cross shaft 378 is journaled in bearing members 380 secured in the kick load bar located beneath the capsule in its docked position. With this configuration once the pin is released and the shaft 808 moved upwardly, the counterweight effects the rotational movement of the bell crank to move the hook 368 out of engagement with the latching bale 374.

The release mechanism further includes a first sheave 382 and a second sheave 384 for locating the pull cord 386 at the desired disposition within the capsule. A cord passage 388 is located in the top portion of the capsule offset from the vertical axis relative to the second sheave 384 to allow the cord to pass through the passage 388 into the capsule. The cord 386 includes a rain boot 390 to prevent moisture or other particles from dropping into the capsule through the passageway while the capsule is docked adjacent oil derrick. With this configuration, the personnel escaping from the racking level of the oil derrick can simply enter the capsule and pull the handle on th cord to actuate the release mechanism. As the A-frame tends to rotate away from the derrick and the capsule lowered relative to te A-frame, the handle and cord will simply pass out of the capsule through the cord passage.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced herein.

What is claimed and desired to be secured by United States Letters Patent is:

1. An escape system for personnel on the derrick of a drilling rig comprising:

(a) a structural member pivotally secured to a portion of said drilling rig;

(b) a personnel carrier being secured to said structural member for supporting the personnel thereon, the personnel carrier having access means for allowing personnel to move from the drilling rig onto the personnel carrier;

(c) said structural member being releasably secured adjacent to said drilling rig;

(d) release means integrated with said structural member and said drilling rig for releasing said structure member from said drilling rig; and (e) means for allowing said structural member with said personnel carrier to pivot away from said drilling rig displacing said personnel carrier with personnel thereon a sufficient distance from said drilling rig to avoid injury of the personnel.

2. The system according to claim 1 wherein said means for pivoting said structural member include said structural member being maintained in an unbalanced position for naturally pivoting away from said drilling rig under the force of gravity when released by said release means.

3. The system according to claim 2 wherein said structural member is releasably secured to said drilling rig at an angle to any vertical line, said angle being sufficient to cause said structural member to pivot outwardly away from said drilling rig under the force of gravity when released by said release means.

4. The system according to claim 3 wherein said personnel carrier includes a capsule, said capsule being located adjacent said drilling rig for access by said personnel.

5. The system according to claim 4 wherein said release means being actuable from within said capsule by said personnel.

6. The system according to claim 1 further comprising means for controlling the rate of movement of said structural member away from said drilling rig when released by said release means.

7. The system according to claim 1 further including a guy assembly for limiting the movement of said structural member beyond a predetermined position relative to a horizontal plane.

8. The system according to claim 7 wherein said guy assembly includes a guy wire having one end attached to said drilling rig and the other end attached to said structural member.

9. The system according to claim 8 wherein said guy wire includes two flexible wires hingedly connected together midway along the length of said wire for allowing said wire to fold as said structural member is maintained releasably secured adjacent said drilling rig.

10. The system according to claim 9 further comprising a shock absorber being attached to said drilling rig and said one end being attached to said shock absorber for absorbing the shock of said structural member as said guide wire reaches its full extended position and the structural member has pivoted to said predetermined position.

11. The system according to claim 1 wherein said personnel carrier is a capsule having an access means thereto, said capsule having a top which is connected to said structural member by a rigid capsule connecting member.

12. The system according to claim 11 wherein said connecting member includes a capsule collapsing assembly for displacing said rigid capsule member away from the top of said capsule once the capsule has reached its predetermined location and said connecting member continues its downward motion.

13. The system according to claim 12 wherein said collapsing assembly includes a capsule link connecting the bottom of said connecting member to the top of said capsule, said link being maintained in an offset disposition to displace the longitudinal axis of said connecting member from the vertical line or axis extending rhrough the top of said capsule.

14. The system according to claim 13 wherein the means for maintaining said link in said offset disposition in an adjustable wire having one end connected to the top of said capsule and the other end connected to a position on the connecting member above the bottom where said capsule link is connected to said connecting member.

15. The system according to claim 14 wherein said top of said capsule includes a capsule lug having a hole therein for receiving a pin, ends of said pin being connected to two parallel links, the top of said links being connected to another pin which is journaled by a connecting member lug carried on the bottom of the capsule connecting member, the flexible wire has one end adjustably secured to said capsule lug, an angular flange extending from the capsule connecting member at a position above the lug, the other end of said wire is secured to said flange, said wire having a length less than the length which is the sum of the length of the link joining the top of the capsule to the bottom of the capsule connecting member and the length between the bottom of the capsule connecting member and the position where the flange extends from the connecting member to maintain the connecting member in an offset disposition relative to the capsule.

16. The system according to claim 1 wherein said personnel carrier is a capsule and said release means is operable from within said capsule to release said structural member from said drilling rig.

17. The system according to claim 16 wherein said release means comprises at least one pin member extending from said structural member, said drilling rig defining a pin receiving aperture, said means including an actuator within said capsule to cause said pin to move out of said aperture to release said structural member from the drilling rig.

18. The system according to claim 17 wherein said pin is maintained in engagement with the pin receiving aperture on the drilling rig by spring means, said engagement being maintained until said release means is actuated to overcome said spring means allowing said pin to be withdrawn from the spring receiving aperture.

19. The system according to claim 18 wherein said means for causing said pin to move out of the pin receiving aperture includes a pneumatic system for providing air pressure against at least a portion of said pin to overcome said spring means.

20. The system according to claim 19 wherein an air poppet is included with said system for overcoming said spring means, said air poppet having two pins, one extending from either side of the air poppet along its longitudinal axis, said drilling rig having two pin receiving apertures located for registering with said pins and being engageable with said pins to maintain said structural member secured adjacent to said drilling rig.

21. The system according to claim 20 wherein said pneumatic system includes a pressurized air source for delivering pressurized air to said poppet, valve means connected between said source and said poppet, said valve means being connected to an actuator within said capsule whereby actuating said actuator to open said valve means allowing pressurized air to flow out of said cylinders to pressurize said pin members.

22. The system according to claim 21 wherein said poppet further includes a cylinder, a piston being attached to each of said pins, said piston having one side for exposure to said pressurized air and another side exposed to ambient air whereby actuation of said valve will pressurize said piston to move within said cylinder removing said pins from said pin receiving apertures.

23. The system according to claim 22 wherein said spring for maintaining said pins engaged with said pin receiving apertures is located within said cylinder and operates to bias said piston against said pressurized air.

24. The system according to claim 23 wherein said cylinder has a first cavity and a second cavity being connected to said air source through said valve and said second cavity carrying said spring, a piston carrying sealing means for sealing said first cavity from said second cavity such that pressurization of said first cavity will cause said piston to move against said spring overcoming said spring means to withdraw said pins from said pin receiving apertures.

25. The system according to claim 24 wherein said drilling rig comprises a support frame having a lateral beam with one end connected to said structure on said drilling rig and the other end extending outwardly from said support structure and carrying block members, said block members defining said pin receiving apertures for cooperating with said pins in said air poppet.

26. An escape system for personnel on the derrick of a drilling rig comprising:

(a) a member having a pivotal end and a distal end;

(b) said derrick carrying a support frame having lateral beam members extending from said support frame and a kick load bar displaced vertically from said lateral beam on said derrick; said member being pivotally secured to said kick load bar at said pivotal end and being secured to said support frame at said distal end to said lateral beam member;

(c) a personnel capsule being secured to said distal end for supporting the personnel thereon and defining access means therein for allowing personnel to move from the derrick into the capsule;

(d) said distal end having a sheave with a groove about its periphery rotatably secured to said distal end;

(e) a running wire, a winch supported by said support frame, said running wire having one end wound about said winch and the other end wound about the groove in said sheave;

(f) said distal end further defining tracks, a roller assembly having rollers for engaging said tracks, said roller assembly being secured to said end of said running wire wound about the peripheral groove of said sheave and the other end of said roller assembly being connected to said capsule;

(g) said distal end further having a release mechanism for releasing said structural member from said lateral beam, said release mechanism being operable from within said capsule, whereby release of said structural member from said lateral beam member will allow said structural frame to pivot away from said derrick and maintain the capsule in a predetermined position relative to the horizontal plane as said structural member moves away from said derrick by the interaction of said roller assembly with said tracks.

27. The system according to claim 26 wherein said system further comprises a back stay guy assembly for limiting the movement of said structural member away from said derrick to a predetermined position.

28. The escape system according to claim 1 further comprising a capsule hanger spar connecting the top of said capsule to said roller assembly, a capsule link assembly making the connection between the bottom of the hanger spar and the top of the capsule, said capsule link assembly maintaining said bar in an offset disposition relative to the top of said capsule for preventing said spar from driving through said capsule once said capsule has been deposited in a predetermined location.

29. An escape system for personnel on the derrick of a drilling rig comprising:

(a) a structural member having a pivotal end and a distal end with said pivotal end being pivotally secured to a portion of said drilling rig;

(b) a personnel carrier being secured to said distal end for supporting the personnel thereon, the personnel carrier having access means for allowing personnel to move from the drilling rig onto the personnel carrier;

(c) said structural member being releasably secured adjacent to said drilling rig;

(d) release means integrated with said structural member and said drilling rig for releasing said structural member in pivotal relationship from said drilling rig;

(e) means for allowing said structural member in said personnel carrier to pivot away from said drilling rig displacing said personnel carrier with personnel thereon a sufficient distance from said drilling rig to avoid injury of the personnel; and (f) means for controlling the rate of movement of said structural member away from said drilling rig when released by release means, said means for controlling the rate of movement including a line having one end secured to said structural member and connected to means for peeling out said line at a predetermined rate.

30. The system according to claim 29 wherein means for peeling out said line include a winch, said line having another end wound about said winch, said winch being integrated with means for controlling the rotational speed of said winch.

31. The system according to claim 30 wherein said means for controlling the rotational speed of said winch includes a hydraulic system connected hydraulically to said winch for limiting rotational speed of said winch as said line is peeled therefrom when said frame structure is released.

32. The system according to claim 31 wherein said hydraulic system includes two systems connected to said winch for providing a redundancy to ensure that said rotational speed of said winch as line is peeled out therefrom is maintained in the event one of said system should fail.

33. The system according to claim 31 wherein said line used in controlling the movement of said structural member away from said drilling rig is a flexible cable.

34. The system according to claim 33 wherein said personnel carrier is rotatably secured to said distal end of said structural member for maintaining said capsule in a predetermined position relative to said horizontal plane as said structural member is rotated away from said drilling rig.

35. The system according to claim 34 wherein said distal end carries a sheave member rotatably secured thereto and configured to receive said running wire about the periphery of said sheave.

36. The system according to claim 35 wherein said distal end further includes guide means and said capsule having connecting means movably secured with said guide means for maintaining the predetermined positon of said capsule as said structural member is pivoted away from said drilling rig.

37. The system according to claim 36 wherein said means movably secured with said guide means for maintaining the predetermined position includes rollers for engaging guide means, said rollers being connected to a link member secured to the top of said capsule.

38. The system according to claim 37 wherein said guide means includes arcuate track means having an upper side and a lower side.

39. The system according to claim 38 wherein said rollers include two rollers secured to said link member for engaging the underside of said arcuate track means and two rollers for engaging the upper side of said arcuate track means, said track means defining an arc throughout the angle of rotation at least equal to the angle of rotation of said structural member away from said drilling rig.

40. The system according to claim 39 wherein said distal end defines an opening at the end of the path defined by the arcuate track means for allowing said second set of rollers to pass therethrough when said structural member has reached the end of its rotation away from said drilling rig such that the capsule will be allowed to move downwardly relative to said distal end.

41. The system according to claim 40 wherein said link is further secured to one end of said running wire wound about said sheave whereby lowering of said structural member will be controlled at a rate of speed defined by the peeling off of said running wire from said winch without downward movement of said capsule relative to said structural member and once said structural member has reached a predetermined position said running wire will continue to be peeled off said winch to lower said capsule relative to said structural member at said predetermined rate of speed.

42. The system according to claim 41 wherein said track means includes two beams being separated by a slotted gap for allowing movement of said link which is of a width less than that of said gap thereby allowing said rollers to move down the path defined by said tracks.

43. The system according to claim 42 further comprising an aligning member pivotally secured adjacent said opening for aligning said rollers with said opening such that said second set of rollers will be located in a registerable position with said opening to pass therethrough during retrieval of said capsule.

44. The system according to claim 43 wherein said aligning member includes a flared end and a guide plate configured substantially identical to the surface of said tracks such that said first set of rollers will engage said guide plate and said flared end in the same manner as it would engage the underside of said track means.

45. The system according to claim 44 wherein said aligning member naturally assumes a vertical position when not engaged by said first set of rollers, in said vertical position upon retrieval of said capsule said second set of rollers will initially engage said flared portion of said aligning member to move said rollers in alignment with said opening, during further retrieval, said guide plate will continue to maintain the rollers in the proper alignment with the opening to avoid the effect of winds and other elements tending to move the capsule and the roller assembly out of alignment with said opening.

46. An escape system for personnel on the derrick of a drilling rig comprising:

(a) means for moving personnel away from said derrick;

(b) said means including a personnel carrier being secured to said derrick for supporting the personnel thereon, said personnel carrier having access means for allowing personnel to move from the derrick onto the personnel carrier;

(c) release means integrated with said derrick and said personnel carrier for releasing said personnel carrier from said derrick; and (d) said release means being operable from said personnel carrier to release said carrier from said drilling rig.

47. The system according to claim 46 wherein said release means comprises a housing having at least one pin member extending therefrom, said derrick defining a pin receiving aperture, said release means including an actuator to cause said pin to move out of said aperture to release said carrier from said derrick.

48. The system according to claim 47 wherein said pin is maintained in engagement with the pin receiving aperture on said derrick by spring means, said engagement being maintained until said release means is actuated to overcome said spring means allowing said pin to be withdrawn from the spring receiving aperture.

49. The system according to claim 48 wherein said means for moving said pin out of the pin receiving aperture includes a pneumatic system for providing air pressure to overcome said spring means.

50. The system according to claim 49 wherein said pneumatic system includes an air poppet with said system for overcoming said spring means, said air poppet having two pins, one extending from either side of the air poppet along its longitudinal axis, said derrick having two pin receiving apertures located for registering with said pins and being engagable with said pins to maintain said personnel carrier secured adjacent to said drilling rig.

51. The system according to claim 50 wherein said pneumatic system includes a pressurized air source for delivering pressurized air to said poppet, valve means connected between said source and said poppet, said valve means being connected to an actuator within said capsule whereby actuating said actuator to open said valve means allowing pressurized air to flow out of said cylinders to pressurize said pin members.

52. The system according to claim 51 wherein said poppet further includes a cylinder defined by said housing, a piston being attached to each of said pins, said piston having one side for exposure to said pressurized air and another side exposed to ambient air whereby actuation of said valve will pressurize said piston to move within said cylinder removing said pins from said pin receiving apertures.

53. The system according to claim 52 wherein said spring for maintaining said pins engaged with said pin receiving apertures is located within said cylinder and operates to bias said piston against said pressurized air.

54. The system according to claim 53 wherein said cylinder has a first cavity and a second cavity being connected to said air source through said valve and said second cavity being connected to said ambient, and said second cavity carrying said spring, a piston carrying sealing means for sealing said first cavity from said second cavity such that pressurization of said first cavity will cause said piston to move against said spring overcomeing said spring means to withdraw said pins from said pin receiving apertures.

55. The system according to claim 54 wherein said derrick comprises a support frame having a lateral beam with one end connected to said structure on said drilling rig and the other end extending outwardly from said support structure and carrying block members, said block members defining said pin receiving apertures for cooperating with said pins in said air poppet.

56. An escape system for personnel on the derrick of a drilling rig comprising:

(a) a personnel carrier being releasably secured to said derrick, the personnel carrier having access means for allowing personnel to move from said derrick rig onto the personnel carrier;

(b) release means integrated with said derrick and said personnel carrier for releasing said carrier from said derrick;

(c) means for moving said personnel carrier away from said derrick displacing said personnel carrier with personnel thereon a sufficient distance from said derrick to avoid injury of the personnel; and (c) means for controlling the rate of movement of said personnel carrier away from said drilling rig when released by release means, said means for controlling the rate of movement including a line having one end secured to said personnel carrier and the other end connected to means for peeling out said line at a predetermined rate.

57. The system according to claim 56 wherein means for peeling out said line include a winch, said line having another end wound about said winch, said winch being integrated with means for controlling the rotational speed of said winch.

58. The system according to claim 57 wherein said means for controlling the rotational speed of said winch includes a hydraulic system connected hydraulically to said winch for limiting rotational speed of said winch as said line is peeled therefrom when said personnel carrier is released.

59. The system according to claim 58 wherein said line used in controlling the movement of said personnel carrier away from said derrick is a flexible cable.

60. The system according to claim 59 wherein said line is peeled out at a constant speed in the range between 4 feet per second and 15 feet per second.

61. The system according to claim 60 wherein said line is peeled out a a constant speed of 9 feet per second.

62. An escape system for personnel on the derrick of a drilling rig comprising:

(a) a personnel carrier being releasably secured to said derrick for supporting the personnel thereon, the personnel carrier having access means for allowing personnel to move from the drilling rig onto the personnel carrier;

(b) release means integrated with said carrier and said derrick for releasing said carrier from said derrick;

(c) moving means for moving said personnel carrier away from said derrick;

(d) said carrier being connected to said moving moving means by a rigid connecting member; and (e) said connecting member including a collapsing assembly for displacing said rigid connecting member away from said carrier once the carrier has reached its predetermined location and said connecting member continues its downward motion.

63. The system according to claim 62 wherein said collapsing assembly includes a carrier link connecting the bottom of said connecting member to said carrier, said link being maintained in an offset disposition to displace the longitudinal axis of said connecting member from the vertical line or axis extending through said carrier.

64. The system according to claim 63 wherein the means for maintaining said link in said offset disposition is an adjustable wire having one end connected to said carrier and the other end connected to a position on the connecting member above the bottom where said carrier link is connected to said connecting member.

65. The system according to claim 64 wherein said carrier includes a lug having a hole therein for receiving a pin the ends of said pin being connected to two parallel links, the top of said links being connected to another pin which is journaled by a connecting member lug carrier on the bottom of the connecting member, the flexible wire has one end adjustably secured to a yoke member, said yoke member being journaled onto a pin between the links and the capsule lug on the top of the capsule, the other end of the wire being secured to an angular flange extending from the carrier connecting member at a position above the lug, said wire and yoke having a length less than the link length which is the sum of the length of the link joining the top of the capsule to the bottom of the connecting member and the length between that lug on the connecting member and the position where the flange extends from the connecting member, to maintain the connecting member in an offset disposition relative to the capsule.

66. An escape system for personnel on a derrick of a drilling rig comprising:

(a) A structural member pivotally secured to a portion of said drilling rig;

(b) A personnel carrier being secured to said structural member for supporting the personnel thereupon, the personnel carrier having access means for allowing personnel to move from the drilling rig onto the personnel carrier;

(c) Said structural member being releasably secured adjacent to said drilling rig;

(d) Release means integrated with said structural member and said drilling rig for releasing said structural member from said drilling rig;

(e) Means for maintaining said structural member in an unbalanced position for naturally pivoting away from said drilling rig under the force of gravity when released by said release means to displace said personnel carrier with personnel thereon a sufficient distance from said drilling rig to avoid injury of said personnel; and (f) Means for biasing said structural member in said unbalanced position to initiate movement of said structural member away from said carrier upon release of said release means.

67. The system according to claim 66 wherein said means for biasing said structure in said unbalanced position includes a spring means releasably secured to said structural member.

68. The system according to claim 67 wherein said spring means includes a helical spring, a tube secured to said drilling rig for carrying said helical spring in a compressed and uncompressed disposition, a shaft member having a portion exposed from one end of said tube and another portion engaged by said helical spring within said tube, said exposed end of said shaft member engaging said structural member when said structural member is secured to said drilling rig and compressing said helical spring to impart a bias against said structural member toward said unbalanced disposition.

69. The system according to claim 68 wherein said shaft extends at least 36″ beyond the end of said cylinder for initiating movement of said structural member upon release thereof for at least a distance of said 36″ under the force of said helical spring.

70. An escape system for personnel on the derrick of a drilling rig comprising:

(a) a structural member pivotally secured to a portion of said drilling rig;

(b) a personnel carrier being secured to said structural member for supporting the personnel thereon, the personnel carrier having access means for allowing personnel to move from the derrick onto the personnel carrier;

(c) said structural member being releasably secured adjacent to said derrick;

(d) release means integrated with said structural member and said derrick for releasing said structural member from said derrick; and (e) means for allowing said structural member with said personnel carrier to pivot away from said derrick displacing said personnel carrier with personnel thereon a sufficient distance from said derrick to avoid injury of the personnel;

(f) means for releasably securing said personnel carrier to said derrick to maintain said personnel carrier secured to said derrick for a predetermined time period after said structural member begins its movement pivoting away from said drilling rig.

71. The system according to claim 70 wherein said predetermined time is that time sufficient to prevent said personnel carrier from swinging back into said derrick during displacement of said carrier said sufficient distance from said drilling rig.

72. The system according to claim 71 wherein said means for releasably securing said personnel carrier to said derrick includes automatic release means for automatically releasing said personnel carrier from said derrick after said structural member has moved through a predetermined distance.

73. The system according to claim 72 wherein said predetermined distance is an arc of between 1° and 2°.

74. The system according to claim 73 wherein said release means includes a latch means movable between a closed position for securing said personnel carrier to said derrick and an open position for releasing said personnel carrier from said derrick, biasing means for biasing said latch means toward the open position, a restraining mechanism cooperating with said biasing means to prevent movement of said latch means to said open position, said restraining mechanism being automatically disengaged from said biasing means after movement of said structural member through said arc for allowing said latch means to move to said open position for releasing said personnel carrier.

75. The system according to claim 74 wherein said latch means includes a bale member, a hook member, said hook member being movable between said open position and said closed position and engaging said bale member in said closed position and disengaging said bale member in the open position.

76. The system according to claim 75 wherein said biasing means includes a weight secured to said hook member such that said hook member will naturally move toward said open position under the force of gravity.

77. The system according to claim 76 wherein said restraining means includes a shaft member releasably engaging said hook member to prevent movement of said hook member to said open position, said restraining means being automatically disengaged from said hook member after said structural member has moved through said arc.

78. The system according to claim 77 wherein said automatic releasing means includes said shaft away from engagement with said hook member, a blocking member engaging said shaft to overcome said bias means, said blocking member being secured to said derrick for disengagement of said shaft upon movement of the structural member throught said arc to allow said shaft to move away and out of disengagement with sahd hook member under the action of said bias.

79. The system according to claim 78 wherein said blocking member includes a cylinder for housing said shaft in a movable relationship, said cylinder carrying a spring for biasing said shaft away from said hook member, said cylinder defining a pin receiving aperture, said shaft defining a pin receiving aperture registerable with said apertures in said cylinder, a pin for insertion through said apertures for restraining movement of said shaft away from said hook member, said pin also being secured to said derrick by a connecting member of predetermined length, said predetermined length of said connecting member being a function of the distance through which said structural member moves before disengaging said personnel carrier from said drilling rig, said cylinder being carried by said structural member whereby movement of said structural member through said arc will effect withdrawal of said pin allowing disengagement of said shaft with said hook member such that said hook member will move to an open position to disengage the personnel carrier from the drilling rig.

80. The system according to claim 79 wherein said hook is a bell crank pivotable between said open and said closed position, said bell crank being pivotally secured to said derrick.

81. An escape system for personnel on the derrick of a drilling rig comprising:

(a) a structural member pivotally secured to a portion of said drilling rig;

(b) a personnel carrier being secured to said structural member for supporting the personnel thereon, the personnel carrier having access means for allowing personnel to move from the drilling rig onto the personnel carrier;

(c) said structural member being releasably secured adjacent to said drilling rig;

(d) release means integrated with said structural member and said drilling rig for releasing said structural member from said driling rig;

(e) means for allowing said structural member with said personnel carrier to pivot away from said drilling rig displacing said personnel carrier with personnel thereon a sufficient distance from said drilling rig to avoid injury of the personnel;

(f) said release means being pneumatically controlled to release said structural member from said drilling rig.

82. The system according to claim 81 wherein said release means being actuated from within said personnel carrier by personnel therein.

83. The system according to claim 82 wherein said pneumatic system includes at least a first source of pressurized gas, said first source carried by said structural member and connected to said release means by a release valve means carried on said structural member, said valve release means being actuated from said personnel carrier to operate said release means for releasing said structural member.

84. The system according to claim 83 wherein said pneumatic system further includes a charge line for charging said first source where said first source may become depleted.

85. The system according to claim 84 wherein said charge line is also connected through said release valve means for providing pressure to said release means from a second source as well as said first source.

86. The system according to claim 85 further comprising a bleed line connected to said first source to depressurize said first source by bleeding gas out of said first source.

87. The system according to claim 86 further comprising a first bleed valve means in said bleed line for bleeding gas from said first source, said first bleed valve means being actuated by personnel on the drilling rig.

88. The system according to claim 87 wherein said first bleed valve means is actuated from a position remote from the location of said first bleed valve means.

89. The system according to claim 88 wherein said first source is at least one cylinder of pressurized air carried by said structural member.

90. The system according to claim 89 wherein said first source includes two cylinders of pressurized air, said structural member having an apex at one end and at the other end being pivotally secured to said derrick, said cylinders being carried adjacent said apex of said structural member.

91. The system according to claim 90 wherein each of said cylinders are carried in a fireproof casing for insulating said cylinders from fire.

92. The system according to claim 91 wherein said cylinders are held in place within said casings by removable crown members removably secured to said apex such that said cylinders can be replaced by simply removing said crown members.

93. The system according to claim 92 further comprising a housing located adjacent the apex of such structural member between the cylinders, said housing carrying said relsase valve means and said bleed valve means, said structural member further comprising legs extending from said pivotal end to said apex, portions of said bleed lines and said charge lines extending through said legs from said housing to a position adjacent said pivotal end, said housing and said legs providing protection for said valve means and said lines from fire and other danger which may be in the vicinity of said structural member.

94. The system according to claim 93 wherein a second release valve means is secured in series with said first release valve means and located on said charge line adjacent said pivotal end and a second bleed valve means being located in series with said first bleed valve adjacent said pivotal end for further controlling the pressure in said bleed line and in said charge line respectively.

95. An elevated tower escape apparatus, comprising:

a personnel carrier for carrying at least one person;

carrier support means;

support mount means mounting said carrier support means to said elevated tower to permit pivotal movement of said support means between an elevated ready position and an escape position below said ready position and away from said tower;

means coupling said personnel carrier to and supporting said carrier from said carrier support means at a location away from the pivotable mounting of said support means to said elevated tower;

securing means releasably securing said support means and said carrier to said tower in said ready position to enable personnel to enter the carrier at an elevated station on the tower;

release means operable by personnel inside the carrier for releasing said securing means and permitting said support means and said carrier to pivot out and away from said elevated tower; and control means coupled with said carrier for controlling the rate of descent of said support means and said carrier toward and to said escape position, so that personnel can exit said carrier at a substantially safe location away from said elevated tower.

96. Apparatus according to claim 95, wherein said releasable securing means is mounted to said elevated tower above said support means and laterally displaced outwardly from a vertical plane containing said support mount means, wherein in said ready position, said capsule support means is disposed at an angle away from the vertical.

97. Apparatus according to claim 95, further comprising:

means engaging said carrier support means for positively urging said support means into motion upon release of said releasable securing means to pivot said carrier out and away from said elevated tower from said ready position toward said escape position.

98. Apparatus according to claim 97, wherein said urging means comprises spring means fixedly coupled to said tower and in biased engagement with said carrier support means when said support means is in its ready position.

99. Apparatus according to claim 95, further comprising:

a guy assembly for restricting movement of said carrier support means beyond a predetermined position intermediate said ready position and said escape position;

wherein said control means comprises means for controlling the descent of said personnel carrier beyond said predetermined intermediate position toward and to said escape position.

100. Apparatus according to claim 95, wherein said means for controlling the descent of said support means and said carrier comprises a controlled speed winch means and cable coupled between said carrier and said tower, wherein, during descent of said carrier toward and to said escape position, said cable is paid out from the winch at a controlled rate.

101. Apparatus according to claim 95, 96, 97, 98, 99 or 100, wherein said personnel carrier comprises an enclosed capsule having a closable access means to permit entry to and exit from the interior of the capsule.

* * * * *

UNITED STATES PATENT AND TRADEMARK OFFICE

CERTIFICATE OF CORRECTION

PATENT NO. : 4,202,427

DATED : May 13, 1980

INVENTOR(S) : Sada et al

It is certified that error appears in the above-identified patent and that said Letters Patent are hereby corrected as shown below:

Column 1, line 57, "e/g.," should read --e.g.,--.
Column 12, line 62, "A-frameis" should read --A-frame is--.
Column 14, line 10, "protion" should read --portion--.
Column 15, line 47, "th" should read --the--.
Column 15, line 50, "te" should read --the--.
Column 22, line 9, "overcomeing" should read --overcoming--.
Column 25, line 24, "sahd" should read --said--.
Column 25, line 65, "driling" should read --drilling--.
Column 26, line 56, "relsase" should read --release--.

Signed and Sealed this

*Nineteenth* Day of *August 1980*

[SEAL]

*Attest:*

SIDNEY A. DIAMOND

*Attesting Officer*

*Commissioner of Patents and Tradema*